US009835991B2

(12) United States Patent
Ishii

(10) Patent No.: US 9,835,991 B2
(45) Date of Patent: Dec. 5, 2017

(54) IMAGE FORMING APPARATUS AND ERASING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroshi Ishii, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/246,591

(22) Filed: Aug. 25, 2016

(65) Prior Publication Data

US 2016/0363892 A1 Dec. 15, 2016

Related U.S. Application Data

(63) Continuation of application No. 15/010,416, filed on Jan. 29, 2016, now Pat. No. 9,452,629.

(30) Foreign Application Priority Data

Mar. 12, 2015 (JP) ..... 2015-049495

(51) Int. Cl.
*G03G 15/20* (2006.01)
*G03G 15/00* (2006.01)
(Continued)

(52) U.S. Cl.
CPC ..... *G03G 15/2039* (2013.01); *B41M 7/0009* (2013.01); *G03G 15/205* (2013.01); *G03G 15/6585* (2013.01); *G03G 21/00* (2013.01)

(58) Field of Classification Search
CPC ..... B41M 7/009; B41M 7/0009; B41M 7/00; G03G 15/2039; G03G 15/205; G03G 15/6585; G03G 21/00
See application file for complete search history.

(56) References Cited

U.S. PATENT DOCUMENTS 7,208,449 B2 4/2007 Sano et al.
8,553,248 B2 10/2013 Kumagai et al.
(Continued)

FOREIGN PATENT DOCUMENTS

JP 2002-357967 12/2002
JP 2005-156758 6/2005
(Continued)

OTHER PUBLICATIONS

Japanese Office Action dated Apr. 11, 2017, filed in Japanese Patent Application No. 2015-049495, 7 pages (with English translation).
(Continued)

*Primary Examiner* — Kristal Feggins
(74) *Attorney, Agent, or Firm* — Patterson & Sheridan, LLP

(57) ABSTRACT

According to an embodiment, an image forming apparatus performs an image forming process to form an image on a sheet, and performs an image erasing process to erase an image formed on a sheet. A conveying device conveys the sheet. A heater heats the sheet conveyed by the conveying device. A cooling device cools the heater. A processor controls the cooling device so that the cooling device cools the heater between an interval of heating the sheet by the heater.

9 Claims, 6 Drawing Sheets

(51) Int. Cl.
*G03G 21/00* (2006.01)
*B41M 7/00* (2006.01)

(56) References Cited

U.S. PATENT DOCUMENTS

| | | | | |
|---|---|---|---|---|
| 9,044,981 | B2 | 6/2015 | Imamiya | |
| 2002/0141775 | A1 | 10/2002 | Mitsuoka et al. | |
| 2005/0134670 | A1* | 6/2005 | Yamamoto | B41M 7/0009 347/179 |
| 2013/0272739 | A1 | 10/2013 | Otaki | |
| 2014/0240434 | A1* | 8/2014 | Yokochi | B41M 7/0009 347/179 |

FOREIGN PATENT DOCUMENTS

| | | |
|---|---|---|
| JP | 2014-095818 | 5/2014 |
| JP | 2014-149373 | 8/2014 |

OTHER PUBLICATIONS

Japanese Decision to Grant a Patent dated Sep. 28, 2017, issued in Japanese counterpart Patent Application No. 2015-049495, 6 pages (with Machine translation).

* cited by examiner

IMAGE FORMING APPARATUS AND ERASING APPARATUS

CROSS-REFERENCE TO RELATED APPLICATIONS

This application is a continuation of co-pending U.S. patent application Ser. No. 15/010,416, filed on Jan. 29, 2016, which is based upon and claims the benefit of priority from the prior Japanese Patent Application No. 2015-049495, filed on Mar. 12, 2015, the entire contents of each of which are incorporated herein by reference.

FIELD

Embodiments described here generally relate to an image forming apparatus and an erasing apparatus.

BACKGROUND

In recent years, image forming apparatuses having image forming functions and image erasing functions are being developed. The temperature necessary to erase images is higher than the temperature necessary to form images. Because of this, the temperature of ejected sheets is high when erasing images, and therefore the sheets may adhere to each other with toner.

DETAILED DESCRIPTION

According to one embodiment, an image forming apparatus performs an image forming process to form an image on a sheet, and performs an image erasing process to erase an image formed on a sheet. The image forming apparatus includes a fusing device, a cooling device, and a processor. The fusing device includes a fusing member and a pressure member, the fusing member being heated by a heat source. The fusing device conveys a sheet, the sheet being heated and pressed between the fusing member and the pressure member. The fusing device fuses the image into the sheet when the image forming process is performed, and erases an image formed on the sheet when the image erasing process is performed. The cooling device performs a cooling process to cool the fusing member of the fusing device. The processor causes the cooling device to perform the cooling process every predetermined timing when the image erasing process is performed.

First, an image-forming-and-erasing apparatus of this embodiment will be described schematically. In the following description, the image-forming-and-erasing apparatus will be simply referred to as an "image forming apparatus". The image forming apparatus of this embodiment cools a fusing device at predetermined timing when the fusing device erases images-to-be-erased. The image-to-be-erased is an image to be erased. The image-to-be-erased is an image formed on a sheet by using an erasable recording material such as erasable toner. The erasable recording material is a recording material that is erasable at a predetermined erasing temperature or more. When the cooling process is performed, the image erasing process is suspended. The cooling process is repeatedly performed every predetermined timing. Since the image erasing process is suspended and the cooling process is performed every predetermined timing, the temperature of ejected sheets, from which images are erased, can be lower. As a result, it is possible to prevent sheets from adhering to each other with toner.

Figure 1:
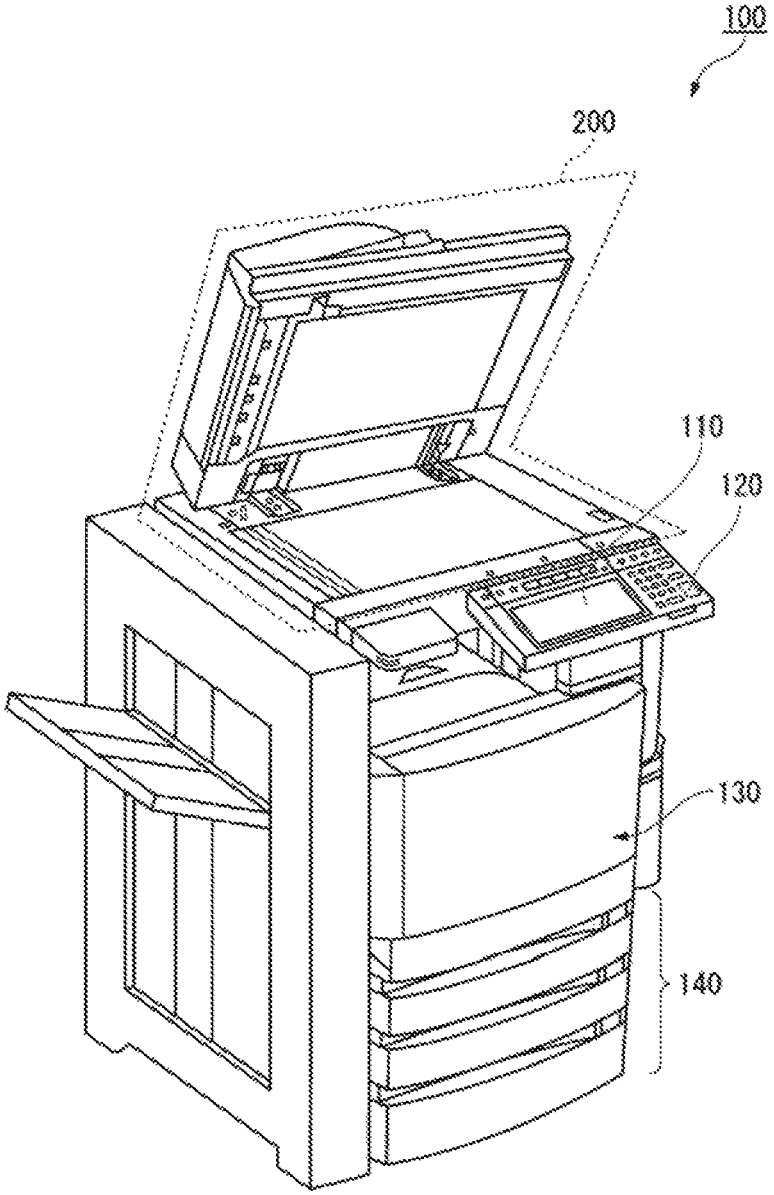
FIG. 1 is an external view showing an image forming apparatus of an embodiment.

Hereinafter, an embodiment will be further described in detail with reference to the drawings. In the drawings, the same reference symbols show the same or similar parts. FIG. 1 is an external view showing an example of the entire structure of the image forming apparatus 100 of this embodiment. The image forming apparatus 100 is, for example, a multi-function peripheral. The image forming apparatus 100 includes the display 110, the control panel 120, the printer 130, the sheet storing device 140, and the scanner 200. In FIG. 1, the scanner 200 includes, for example, an automatic document feeder that conveys documents to the image-reading position of the scanner 200.

The image forming apparatus 100 forms images on sheets by using developer such as toner as the above-mentioned recording material to form images. The sheets are, for example, sheets such as paper and label sheets. The sheets may be any recording media on which the image forming apparatus 100 can form images.

The display 110 is an image display apparatus such as a liquid crystal display and an organic EL (Electro Luminescence) display. The display 110 displays various kinds of information on the image forming apparatus 100.

The control panel 120 includes buttons. The control panel 120 receives user's operations. Examples of the user's operation include an image erasing instruction (described later). The control panel 120 outputs signals corresponding to the user's operations to the processor 300 (see FIG. 2 described below) of the image forming apparatus 100. Note that an all-in-one touch panel, which includes the display 110 and the control panel 120, may be provided.

The printer 130 performs image forming process and image erasing process. In the image forming process, the printer 130 forms images on sheets based on obtained image information. The printer 130 heats the sheets, on which the images are formed, to thereby fuse the images into the sheets. The fusing device 50 (see FIG. 2 and FIG. 3 described below) performs heating for the image forming process. The fusing device 50 heats the sheets at a temperature (fusing temperature) necessary to fuse the developer and thereby fuses the images. The image information used to form images may be image information generated by the scanner 200 or image information received via a communication path such as a network.

In the image erasing process, the printer 130 heats the sheets on which images-to-be-erased are formed, and thereby erases the image-to-be-erased. For example, the fusing device 50 of the printer 130 performs heating in the image erasing process. The fusing device 50 heats the sheets at an erasing temperature or more to thereby erase the images-to-be-erased. The erasing temperature is higher than the fusing temperature in the image forming process. For example, the heat roller 501 (see FIG. 3 described later) of the fusing device 50 is heated at 100 degrees (fusing temperature) when performing the image forming process. For example, the heat roller 501 of the fusing device 50 is heated at 130 degrees (erasing temperature) or more when performing the image erasing process. Further, the belt heating roller 515 (see FIG. 3 described later) of the fusing device 50 is heated at, for example, 90 degrees when performing the image forming process. Further, the belt heating roller 515 (see FIG. 3 described later) of the fusing device 50 is heated at, for example, 120 degrees or more when performing the image erasing process.

The sheet storing device 140 includes a cassette that stores sheets on which the printer 130 forms images. Further, the sheet storing device 140 includes a cassette that stores sheets from which the printer 130 erases images.

The scanner 200 reads image information of a document-to-be-read as lightness contrast. The scanner 200 stores the read image information. The stored image information may be sent to another information processing apparatus via the network. The printer 130 may form images on sheets based on the stored image information.

Figure 2:
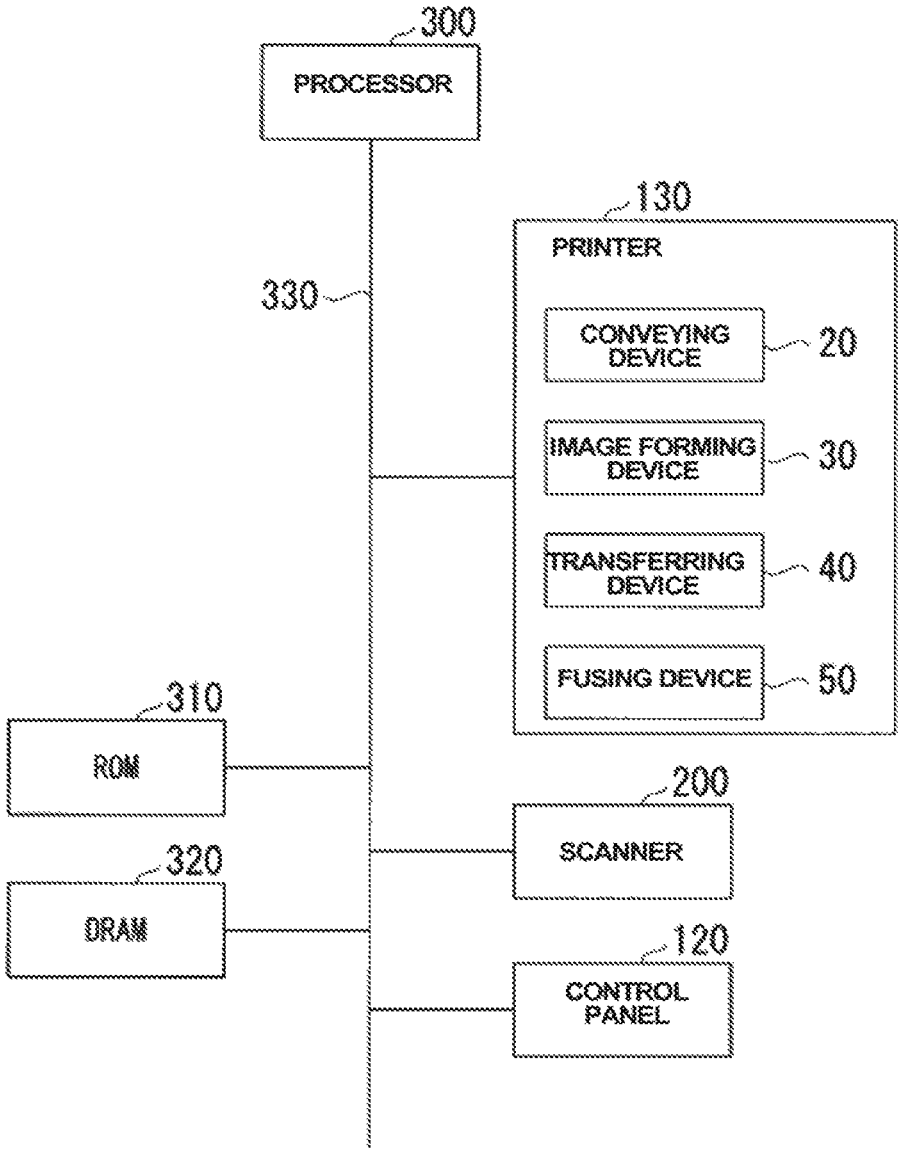
FIG. 2 is a block diagram schematically showing the image forming apparatus of this embodiment.

FIG. 2 is a block diagram schematically showing the image forming apparatus 100. The image forming apparatus 100 includes the control panel 120, the printer 130, the scanner 200, the processor 300, the ROM 310, and the DRAM 320. The structural units are connected with each other via the system bus 330 such that they are capable of sending/receiving data to/from each other.

As shown in FIG. 2, the printer 130 includes the conveying device 20, the image forming device 30, the transferring device 40, and the fusing device 50. The printer 130 performs the image forming process as follows. The conveying device 20 of the printer 130 draws a sheet, on which an image is to be formed, from the sheet storing device 140. The conveying device 20 conveys the drawn sheet to the transferring device 40 and to the fusing device 50. The image forming device 30 of the printer 130 forms an electrostatic latent image on a photosensitive drum (not shown), for example, based on the image information of the document. The image forming device 30 attaches the developer on the electrostatic latent image, and thereby forms a visible image (image of developer). Toner is a specific example of the developer. The transferring device 40 of the printer 130 transfers the image of the image developer to the sheet. The fusing device 50 of the printer 130 heats the sheet at the fusing temperature, presses the sheet, and thereby fuses the image of the developer into the sheet. Note that a user may manually feed a sheet on a manual-feed tray (not shown), and an image may be formed on the manually-fed sheet.

The printer 130 performs the image erasing process as follows. The conveying device 20 of the printer 130 draws a sheet (sheet-to-be-erased) for the image erasing process from the sheet storing device 140. The conveying device 20 conveys the drawn sheet to the fusing device 50. The fusing device 50 of the printer 130 heats the sheet at the erasing temperature or more, presses the sheet, and thereby erases the image-to-be-erased. Note that a user may manually feed a sheet on a manual-feed tray (not shown), and an image may be erased from the manually-fed sheet.

The processor 300 controls the respective structural units connected thereto via the system bus 330. The ROM 310 stores various control programs necessary to operate the processor 300. The ROM 310 stores, for example, programs that control the image forming process and the image erasing process. The DRAM 320 is used as a storage area that temporarily stores data when the processor 300 executes programs.

Figure 3:
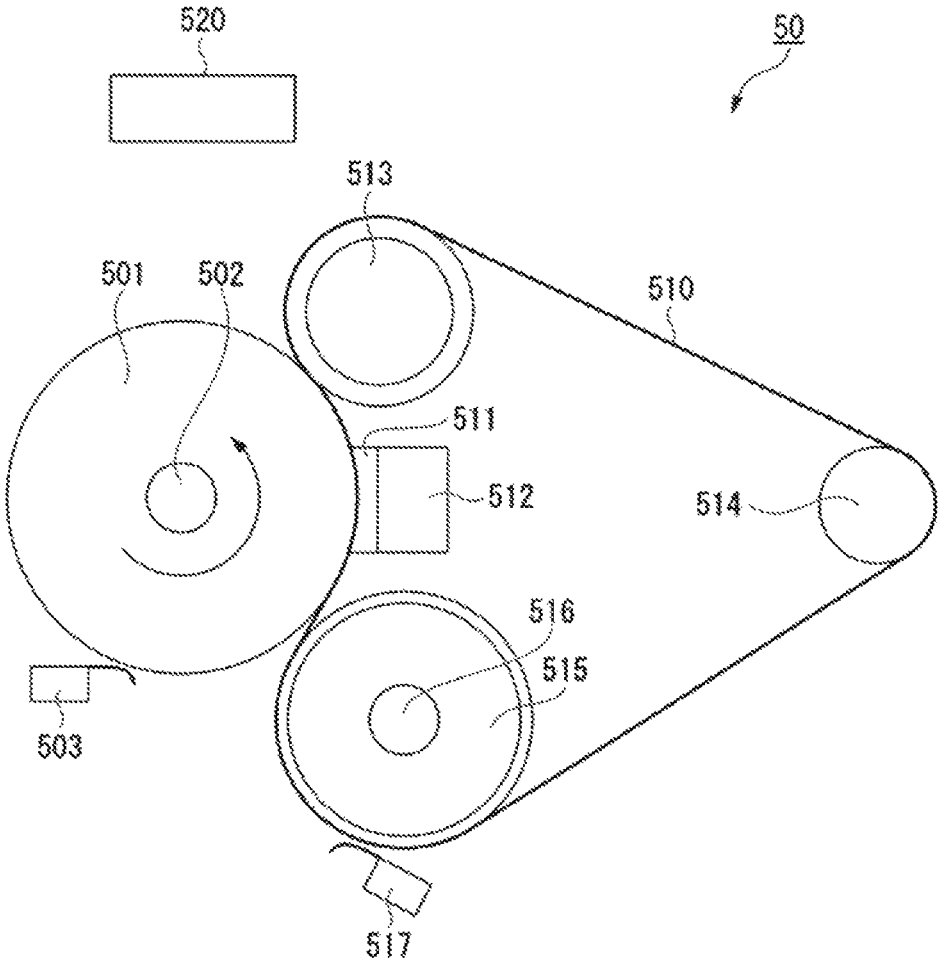
FIG. 3 is a diagram schematically showing a fusing device of the image forming apparatus of FIG. 1.

FIG. 3 is a diagram schematically showing an example of the structure of the fusing device 50 of the printer 130. The fusing device 50 is a fusing-and-erasing device. The fusing device 50 includes the heat roller 501 as a fusing member when it functions as a fusing device and as a heating member when it functions as an erasing device. The fusing device 50 includes, as pressure members, the pressure belt 510, the pressure pad 511, the pad holder 512, the pressure roller 513, the tension roller 514, and the belt heating roller 516.

Further, the fusing device 50 includes the HR lamp 502, the HR thermistor 503, the pressure belt lamp 516, the pressure thermistor 517, and the cooling device 520. Note that the fusing device 50 may include the cooling device 520 alternatively.

The heat roller 501 is a member having a cylindrical shape. The HR lamp 502 is provided in the heat roller 501. The HR lamp 502 generates heat, and thereby heats the heat roller 501 at the fusing temperature or at the erasing temperature or more. The HR thermistor 503 measures the surface temperature of the heat roller 501.

The pressure belt 510 is held by the pressure roller 513, the tension roller 514, and the belt heating roller 515. The pressure pad 511 and the pressure roller 513 cause the pressure belt 510 to pressure-contact the heat roller 501. Thanks to the pressure-contact, a nipped part is formed between the pressure belt 510 and the heat roller 501.

The pressure pad 511 pressure-contacts the heat roller 501, the pressure belt 510 being interposed therebetween, and is held. The pad holder 512 holds the pressure pad 511, the pressure pad 511 pressure-contacting the heat roller 501.

The pressure roller 513 is arranged at the downstream in the sheet-conveying direction. The pressure roller 513 causes the pressure belt 510 to pressure-contact the heat roller 501. The nipped part ends at the pressure roller 513. The tension roller 514 is arranged apart from the pressure roller 513 and the belt heating roller 515, and thereby provides the tension of the pressure belt 510. The belt heating roller 515 is arranged at the upstream in the sheet-conveying direction. The belt heating roller 515 is a member having a hollow cylindrical shape. The pressure belt lamp 516 is provided in the belt heating roller 515. The pressure belt lamp 516 generates heat, and thereby heats the belt heating roller 515.

As the pressure belt lamp 516, for example, a halogen lamp is used. The pressure thermistor 517 measures the surface temperature of the pressure belt 510 near the belt heating roller 515. The cooling device 520 cools the heat roller 501. Since the cooling device 520 cools the heat roller 501, the surface temperature of the heat roller 501 drops faster than that of an uncooled heat roller. The cooling device 520 may have any structure that can cool the heat roller 501. The cooling device 520 may be, for example, an air-blower that blows air into the heat roller 501 by using a fan rotated by a motor. As shown in FIG. 3, for example, the cooling device 520 is arranged at the downstream side in the sheet-conveying direction of the heat roller 501. Further, the cooling device 520 is arranged above the heat roller 501, for example.

Next, how the processor 300 controls the image erasing process will be described in detail. When an image-to-be-erased is erased controlled by the processor 300, the fusing device 50 is cooled at predetermined timing controlled by the processor 300. The predetermined timing contains timing at which images are erased from a predetermined threshold number of sheets, and timing at which the image erasing process based on an image erasing instruction from a user received by the control panel 120 is completed. The cooling process performed at timing at which images are erased from a predetermined threshold number of sheets will be referred to as the first cooling process in the following description. Meanwhile, the cooling process performed at timing at which the image erasing process is completed will be referred to as the second cooling process in the following description. Note that the simple "cooling process" means the first and/or second cooling processes/process. The first cooling process is completed when, for example, the surface temperature of the heat roller 501 reaches a predetermined threshold temperature (cooling-target temperature). In other words, the first cooling process is continued until, for example, the surface temperature of the heat roller 501 reaches the cooling-target temperature. Alternatively, the first cooling process may be completed after it continues for a predetermined time period, for example. The predetermined time period is determined arbitrarily based on the experimental results of FIG. 5 and FIG. 6 (described later). The cooling device 520 continues the first cooling process until the first cooling process is completed even if the control panel 120 receives an image erasing instruction from a user during the first cooling process. When the cooling device 520 completes the first cooling process, the fusing device 50 performs the image erasing process based on the received image erasing instruction from a user. To the contrary, the second cooling process is completed when the surface temperature of the heat roller 501 reaches the cooling-target temperature, or is finished based on the image erasing instruction from a user. So the cooling device 520 finishes the second cooling process when the control panel 120 receives an image erasing instruction from a user during the second cooling process. When the cooling device 520 completes the second cooling process, the fusing device 50 performs the image erasing process based on the received image erasing instruction from a user.

The processor 300 controls the cooling device 520 to perform the cooling process as follows. The processor 300 drives the cooling device 520 at the predetermined timing. Further, the processor 300 turns off the HR lamp 502, and thereby stops heating the heat roller 501. The processor 300 may not turn off the HR lamp 502 and reduce the electric power supplied to the HR lamp 502 instead, and thereby may heat the heat roller 501 less. As the result of this process, the surface temperature of the heat roller 501 is reduced. The processor 300 obtains the surface temperature of the heat roller 501 based on the output from the HR thermistor 503. When the surface temperature of the heat roller 501 drops and reaches the cooling-target temperature or less, the processor 300 completes the cooling process by the cooling device 520. The cooling-target temperature is lower than the erasing temperature. The cooling-target temperature is equal to or lower than the fusing temperature (for example 100 degrees), at which the heat roller 501 is heated during the image forming process, for example. In other words, the processor 300 controls the HR lamp 502 such that the surface temperature of the heat roller 501 drops below erasing temperature, and, at the same time, causes the cooling device 520 to perform the cooling process. The processor 300 suspends the image erasing process when the cooling device 520 performs the first cooling process. Meanwhile, if the control panel 120 receives an image erasing instruction when the cooling device 520 performs the second cooling process, the processor 300 causes the cooling device 520 to finish the cooling process and causes the fusing device 50 to perform the image erasing process. The processor 300 repeats that control every predetermined timing, and thereby causes the cooling device 520 to perform the first and second cooling processes. When the image erasing process is performed after the cooling process, the processor 300 increases the surface temperature of the heat roller 501. The surface temperature of the heat roller 501 is increased to reach the erasing temperature (for example 130 degrees). The processor 300 controls the HR lamp 502 of the heat roller 501 based on the predetermined temperature depending on each process such that the surface temperature of the heat roller 501 reaches the temperature (erasing temperature) necessary for the image erasing process or the temperature (fusing temperature) necessary for the image forming process.

The processor 300 counts the number of sheets from which images are erased. The image forming apparatus 100 includes a sensor that detects sheets, the number of which is to be counted by the processor 300. In this embodiment, for example, the sheet storing device 140 includes the sensor. The sensor detects sheets drawn from the sheet storing device 140 for the image erasing process. The processor 300 includes a counter that counts the number of sheets based on the result of detecting sheets by the sensor. The counter is a nonvolatile memory that stores the counted number, for example. In other words, the processor 300 detects, by using the sensor, sheets drawn from the sheet storing device 140 as the number of sheets from which images are erased. The processor 300 increments the counter every time the sensor detects the sheet, and thereby counts the number of sheets. The counter's value is held even if the image forming apparatus 100 is powered off. When the counter's value reaches a threshold number, that shows a predetermined sheet number, or more, the processor 300 suspends the image erasing process, and causes the cooling device 520 to execute the first cooling process. Further, when the image erasing process instructed by a user is completed, the processor 300 causes the cooling device 520 to perform the second cooling process. When the first cooling process is completed, the processor 300 resets the counter's value. The counter's value is reset and thereby returns to the default value (zero). Note that, for example, a sheet-ejecting unit (not shown) of the image forming apparatus 100 may include the sensor. If the sheet-ejecting unit of the image forming apparatus 100 includes the sensor, the sensor detects sheets, from which images are erased, ejected to the sheet-ejecting unit of the image forming apparatus 100.

As described above, even if the image forming apparatus 100 is powered off, the counter's value at the time of power-off is held as it is. When the image erasing process is performed after power-on, the latest counter's value at the time of power-off is incremented. Because of this, even if the image forming apparatus 100 is powered off without being cooled at all and is powered on immediately after that, it is possible to prevent the fusing device 50 from being heated too much.

When the cooling device 520 starts the cooling process, the processor 300 changes cooling flag's value by recording a value showing the cooling status. The cooling flag is a flag showing if the cooling process is being performed or not. The cooling flag's value is stored in a nonvolatile storage unit (not shown). The cooling flag's value is held even if the image forming apparatus 100 is powered off. In the following description, "to set the cooling flag" means to change the cooling flag's value by recording the value showing the cooling status. "To reset the cooling flag" means to change the cooling flag's value by recording the value showing the uncooling status. The processor 300 sets the cooling flag when the cooling process is started. The processor 300 keeps the state where the cooling flag is set during the cooling process. The processor 300 resets the cooling flag when the cooling process is completed or finished. For example, if the image forming apparatus 100 is powered off without completing the cooling process after the cooling process is started, the cooling flag's value, i.e., the value showing the cooling status, is held as it is. When the image forming apparatus 100 is powered on after that, the processor 300 refers to the cooling flag's value and causes the cooling device 520 to perform the cooling process if necessary. In other words, if the cooling flag is set when the image forming apparatus 100 is powered on, the processor 300 causes the cooling device 520 to perform the cooling process. Because of this, even if the image forming apparatus 100 is powered off without being cooled completely and is powered on immediately after that, it is possible to prevent the fusing device 50 from being heated too much.

Figure 4:
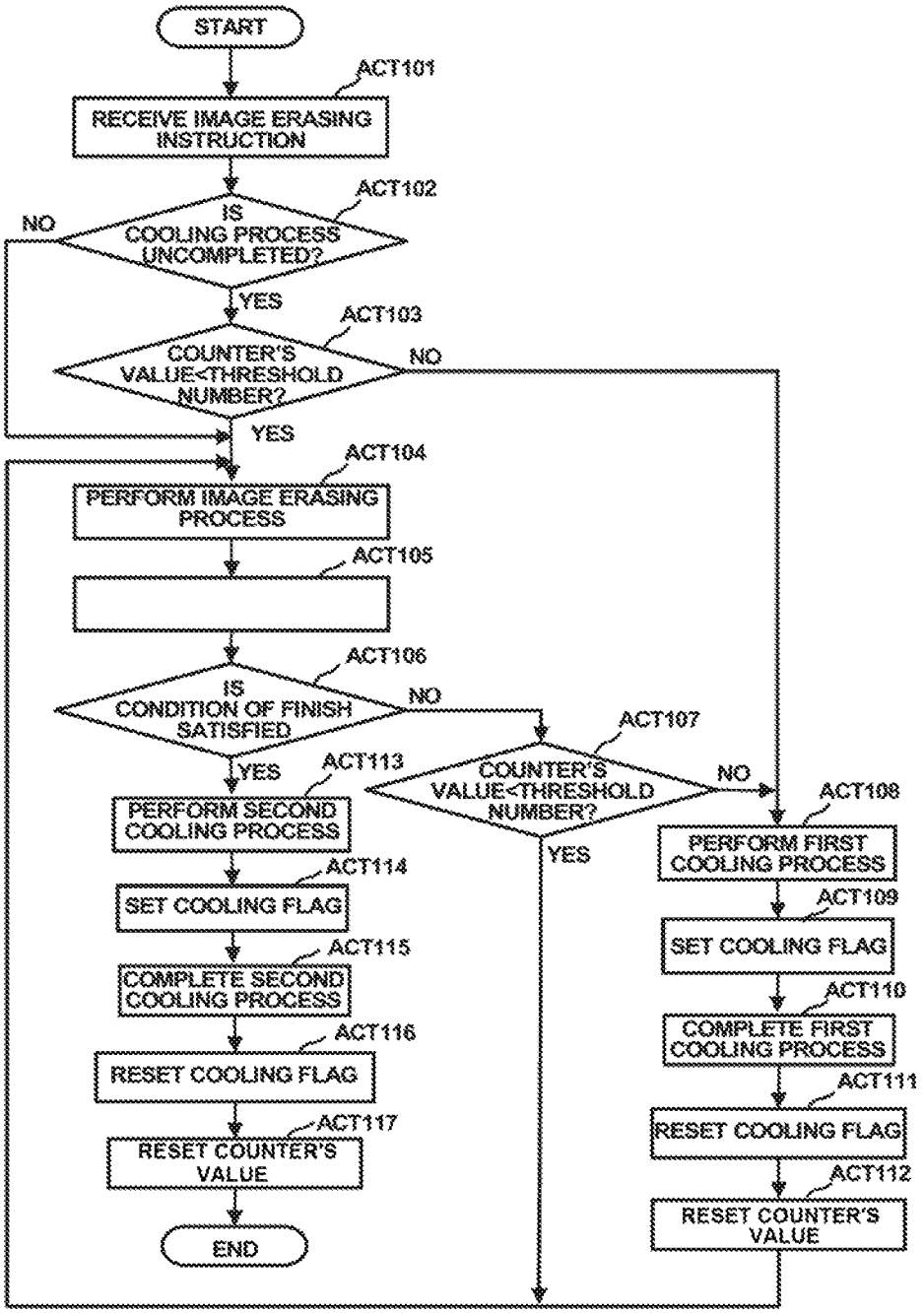
FIG. 4 is a flowchart showing an example of the control behavior of a processor of this embodiment.

FIG. 4 is a flowchart showing an example of the control behavior of the processor 300. In ACT101, the processor 300 detects if the control panel 120 receives an image erasing instruction from a user. In ACT102, the processor 300 detects if the cooling flag is set or not. In other words, the processor 300 determines if the cooling process is completed or not based on the fact that the cooling flag is set or not. If it is determined that the cooling process is uncompleted, i.e., the cooling flag is set (ACT102, YES), the processor 300 proceeds to ACT103. In ACT103, the processor 300 determines if the counter's value is smaller than the threshold number or not. In other words, the processor 300 determines if the total number of sheets, from which images are erased, reaches the threshold number or not. If the counter's value is smaller than the threshold number (ACT103, YES), the processor 300 determines that it is not time to perform the first cooling process. In other words, the processor 300 determines that the uncompleted cooling process is the second cooling process. Further, the processor 300 finishes the uncompleted second cooling process and resets the cooling flag. After that (ACT103, YES), the processor 300 proceeds to ACT104. In ACT104, the processor 300 causes the fusing device 50 to perform the image erasing process based on the image erasing instruction from a user. Specifically, the processor 300 causes the conveying device 20 to convey sheets, from which images are to be erased, from the sheet storing device 140 to the fusing device 50. The fusing device 50 erases images from the conveyed sheets. As described above, if the image erasing instruction is received via the control panel 120 and if the uncompleted cooling process is the second cooling process, the processor 300 finishes the uncompleted cooling process without continuing. After the uncompleted second cooling process is finished, the processor 300 causes the fusing device 50 to perform the image erasing process based on the image erasing instruction from a user. Meanwhile, if the cooling process is completed in ACT102 (ACT102, NO), the processor 300 proceeds to ACT104. In ACT104, the processor 300 causes the fusing device 50 to perform the image erasing process based on the image erasing instruction from a user. After that, in ACT105, the processor 300 increments the counter's value. In other words, the processor 300 adds one to the counter's value.

Next, in ACT106, the processor 300 determines if the condition to finish is satisfied or not. The "condition to finish" is a condition to finish the image erasing process based on the image erasing instruction of ACT101. The image erasing instruction includes the condition to finish. The condition to finish may be, for example, the number of sheets from which images are to be erased, the number of sheets being preset by a user. Alternatively, for example, the condition to finish may be the number of sheets from which images are to be erased, the number of sheets being preset for the image forming apparatus 100. In those cases, in ACT106, the processor 300 determines if the number of sheets, from which images are erased, reaches the preset number or not. Further, for example, the condition to finish may be the fact that the sheet storing device 140 does not store anymore sheets, from which images are to be erased.

If the condition to finish is not satisfied (ACT106, NO), the processor 300 proceeds to ACT107. In ACT107, the processor 300 determines if the counter's value is smaller than the threshold number or not. In other words, the processor 300 determines if the total number of sheets, from which images are erased, reaches the threshold number or not. If the counter's value is smaller than the threshold number (ACT107, YES), the processor 300 returns to ACT104. In ACT104, as described above, the processor 300 causes the fusing device 50 to perform the image erasing process. In other words, if the condition to finish is not satisfied and if the counter's value is smaller than the threshold number, the processor 300 repeats the processes of ACT104 to ACT107.

Further, in ACT103, if it is determined that the counter's value is equal to or larger than the threshold number, i.e., the total number of sheets from which images are erased reaches the threshold number (ACT103, NO), the processor 300 determines that it is time to perform the first cooling process. In other words, the processor 300 determines that the uncompleted cooling process is the first cooling process. Next, in ACT108, the processor 300 causes the cooling device 520 to perform the first cooling process. In other words, if the uncompleted cooling process is the first cooling process, the processor 300 causes the cooling device 520 to continue the first cooling process without causing the cooling device 520 to finish the uncompleted first cooling process. Further, in ACT109, the processor 300 sets the cooling flag. In other words, the processor 300 maintains the state where the cooling flag is set. Meanwhile, in ACT107, if it is determined that the counter's value is equal to or larger than the threshold number, i.e., the total number of sheets from which images are erased reaches the threshold number (ACT107, NO), the processor 300 determines that it is time to perform the first cooling process. Next, in ACT108, the processor 300 causes the cooling device 520 to perform the first cooling process. When the first cooling process is started, in ACT109, the processor 300 sets the cooling flag. After that, in ACT110, the processor 300 determines that the surface temperature of the heat roller 501 reaches the cooling-target temperature, and then completes the first cooling process. Further, in ACT111, the processor 300 resets the cooling flag. Further, in ACT112, the processor 300 resets the counter's value. When the counter's value is reset, the processor 300 returns to ACT104. As described above, if the first cooling process, which was started immediately before performing the image erasing process, is not completed, the processor causes the cooling device to continue the first cooling process. After the cooling process is completed, the processor causes the fusing device to perform the image erasing process.

Further, in ACT106, if the condition to finish is satisfied (ACT106, YES), the processor 300 proceeds to ACT113. In ACT113, the processor 300 causes the cooling device 520 to perform the second cooling process. When the second cooling process is started, in ACT114, the processor 300 sets the cooling flag. After that, in ACT115, the processor 300 determines that the surface temperature of the heat roller 501 reaches the cooling-target temperature, and then completes the second cooling process. When the second cooling process is completed, in ACT116, the processor 300 resets the cooling flag. When the cooling flag is reset, in ACT117, the processor 300 resets the counter's value. After the above-mentioned processes, the processor 300 finishes the image erasing process based on the image erasing instruction of ACT101.

As described above, the image forming apparatus 100 erases images-to-be-erased by using the fusing device 50. Further, the image forming apparatus 100 cools the fusing device 50 by using the cooling device 520 at predetermined timing. Because of this, the temperature of ejected sheets, from which images-to-be-erased are erased, can be lower. As a result, it is possible to prevent sheets from adhering to each other with toner.

Figure 5:
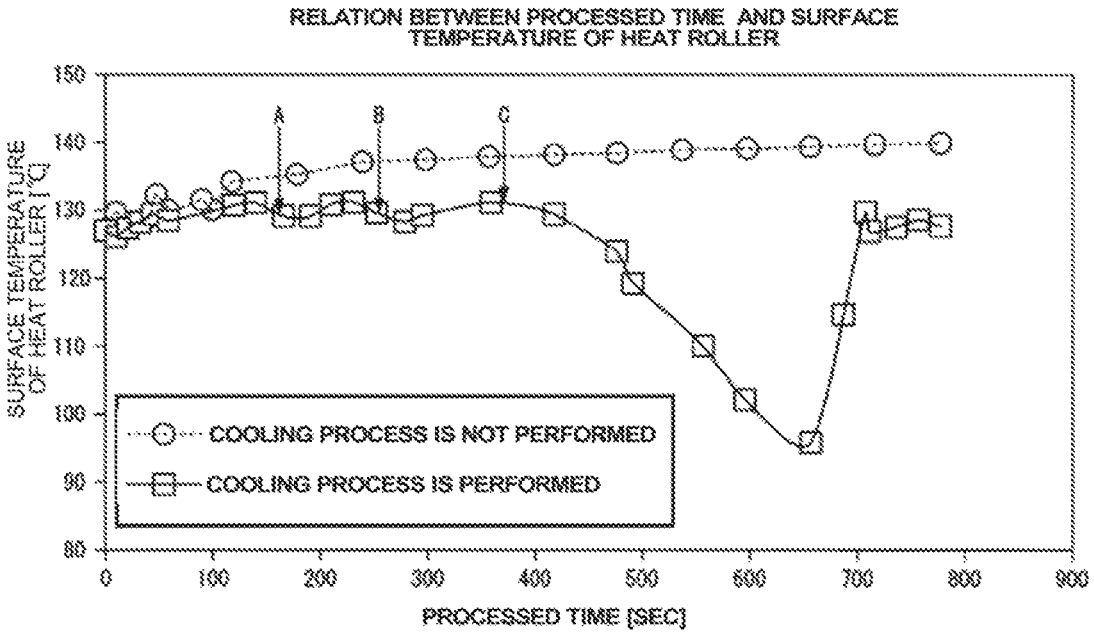
FIG. 5 is a graph showing the relation between the processed time and the surface temperature of a heat roller of this embodiment.

Hereinafter, effects of the image forming apparatus 100 will be described in detail. FIG. 5 is a graph showing the relation between the processed time (sec) and the surface temperature of the heat roller 501 of the fusing device 50. The processed time shows the elapsed time after the fusing device 50 starts the image erasing process. In FIG. 5, the horizontal axis shows the processed time. In FIG. 5, the vertical axis shows the surface temperature of the heat roller 501 of the fusing device 50. In the graph, the dashed line (uncooled) shows the change of the temperature of the surface of the heat roller 501 when the image erasing process is continued without cooling. In the graph, the solid line (cooled) shows the change of the temperature of the surface of the heat roller 501 in the image erasing process of the image forming apparatus 100 of this embodiment. In other words, in the graph, the solid line shows the change of the temperature of the surface of the heat roller 501 when the cooling process is performed every predetermined timing.

In this embodiment, stability control is employed to keep the temperature of the surface of the heat roller 501 near about 130° C. According to the stability control, the predetermined temperature, at which the fusing device 50 is cooled, is decreased depending on a time period in which sheets are continuously supplied to the fusing device 50. As a result, the temperature of the surface of the heat roller 501 is to be changed within a target temperature range. According to the stability control of this embodiment, timing at which the predetermined temperature is decreased is controlled based on time. According to the stability control of this embodiment, for example, the predetermined temperature is decreased by about 2° C. when the processed time reaches about 140 sec, and the predetermined temperature is decreased by about 3° C. when the processed time reaches about 230 sec. In FIG. 5, each of the points A and B shows timing at which the predetermined temperature is decreased. The predetermined temperature is decreased, i.e., controlled, based on a prepared table, that stores the relation between processed time and drop of temperature. In other words, the processor 300 reads the drop of temperature in relation to the processed time from the table, and controls the temperature of the heat roller 501 (the HR lamp 502). Thanks to the stability control, the temperature of the surface of the heat roller 501 of the fusing device 50 is kept around 130° C.

However, even if the above-mentioned stability control is performed, the temperature of the surface of the heat roller 501 of the fusing device 50 tends to increase slightly (see FIG. 5, point C). In order to prevent the temperature of the surface of the heat roller 501 from increasing, the above-mentioned first cooling process is performed at timing when the processed time reaches about 400 sec. Thanks to the cooling process, the temperature of the surface of the heat roller 501 drops and reaches about 100 degrees as shown in the solid line of FIG. 5. After that, the temperature of the surface of the heat roller 501 is increased again and reaches the erasing temperature (for example 130 degrees) necessary to perform the image erasing process. Then the image forming apparatus 100 proceeds with the image erasing process.

If the cooling process is not performed, the temperature of the surface of the heat roller 501 increases, and thereby ejected sheets adheres to each other when the image erasing process is performed for a long period of time without stopping, which is problematic. According to this embodiment, even if about 300 sheets, from which images are to be erased, are supplied to the fusing device 50 continuously, it is possible to previously prevent the temperature of the surface of the heat roller 501 from increasing. Because of this, ejected sheets do not adhere to each other, and the image erasing process can be performed for a long period of time without stopping.

Figure 6:
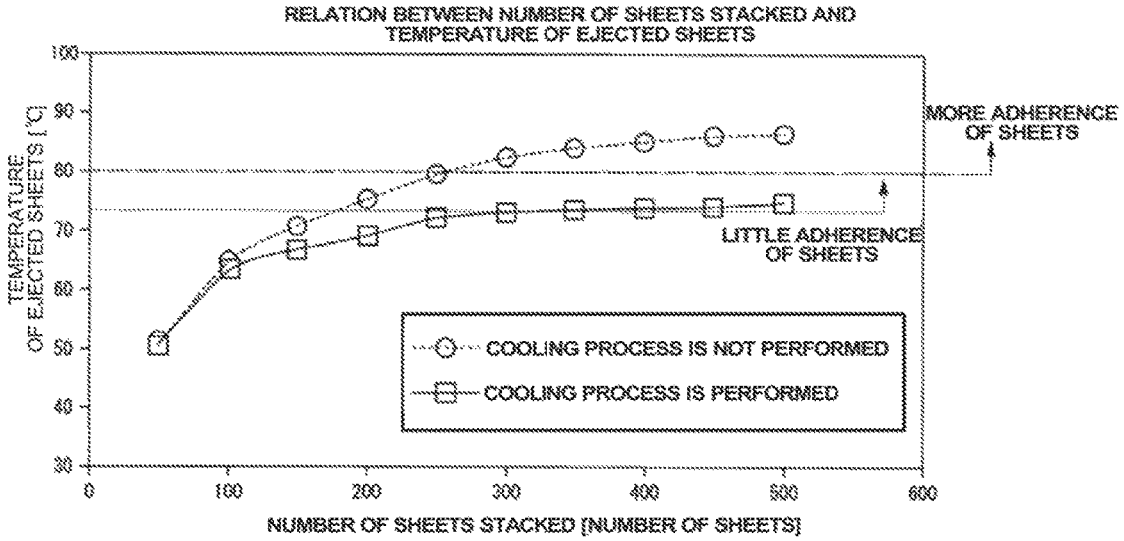
FIG. 6 is a graph showing the relation between the number of ejected sheets stacked and the temperature of ejected sheets being ejected of this embodiment.

FIG. 6 is a graph showing the relation between the number of ejected sheets stacked and the temperature of ejected sheets being ejected. The "ejected sheet" means an ejected sheet, from which images are erased by the image forming apparatus 100. The "number of stacked sheets" means the number of ejected sheets stacked on an ejecting unit (not shown) of the image forming apparatus 100, the ejected sheets having been ejected into the ejecting unit without stopping. In the graph of FIG. 6, the horizontal axis shows the number of stacked sheets. In the graph of FIG. 6, the vertical axis shows the temperature of ejected sheets being ejected. In the graph of FIG. 6, the dashed line shows the change of the temperature of ejected sheets being ejected, the image erasing process being performed without stopping and without performing the cooling process. In the graph of FIG. 6, the solid line shows the change of the temperature of ejected sheets being ejected, the image erasing process being performed by the image forming apparatus 100 of this embodiment. In other words, in the graph, the solid line shows the change of the temperature of ejected sheets being ejected, the cooling process being performed every predetermined timing.

The larger the number of stacked sheets, the longer the elapsed time after the image erasing process is started. The larger the number of stacked sheets, the higher the temperature of the surface of the heat roller 501 of the fusing device 50. As the temperature of the surface of the heat roller 501 of the fusing device 50 increases, the temperature of ejected sheets being ejected increases. Note that the temperature of ejected sheets being ejected when the cooling process is not performed is much higher than the temperature of ejected sheets being ejected when the cooling process is performed. In the experiment, the result of which is shown in the graph of FIG. 6, when the temperature of ejected sheets being ejected exceeds about 70 degrees, a small number of sheets adhered to each other (little adherence of sheets). Further, in the experiment, the result of which is shown in the graph of FIG. 6, when the temperature of ejected sheets being ejected exceeds about 80 degrees, a larger number of sheets adhered to each other (more adherence of sheets). According to this embodiment, the image forming apparatus 100 performs the cooling process every predetermined timing. Because of this, the temperature of ejected sheets being ejected, i.e., the temperature at which a less number of sheets adhered to each other, can be kept.

A designer of the image forming apparatus 100, for example, conducts the experiments shown in FIG. 5 and FIG. 6, and arbitrarily determines when to perform the cooling process and how long the cooling process is to be continued.

If the fusing device 50 as a unit is mounted on the image forming apparatus 100, the fusing device 50 may include a controller that behaves similar to the processor 300.

The cooling process may be performed after a predetermined time period passes after the erasing process is started, for example, which can be the predetermined timing. Further, the cooling process may be performed when the temperature of the surface of the heat roller 501 of the fusing device 50 that performs the erasing process reaches a predetermined temperature, for example, which can be the predetermined timing. Alternatively, the cooling process may be performed when all the conditions of both the types of the timing are satisfied, which can be the predetermined timing. In other words, the predetermined timing is determined based on at least one of the number of sheets from which images are erased, the elapsed time after the image erasing process is started, and the temperature of the fusing member of the fusing device.

The timing at which the cooling process is completed is not necessarily limited to the timing at which the temperature of the surface of the heat roller 501 drops below the cooling-target temperature. For example, as described above, the processor 300 may complete the cooling process after a predetermined time period passes after the cooling process is started.

The specific value of the predetermined timing (the threshold number) at which the first cooling process is performed may be determined based on the size of sheets from which images are to be erased. For example, the processor 300 may have a table that prestores the predetermined threshold number of sheets from which images are erased in relation with each sheet size. In this case, the processor 300 obtains, with reference to the table, the predetermined threshold number depending on the size of sheets from which images are to be erased.

According to at least one of the above-mentioned embodiments, the image erasing process is suspended every predetermined timing and the cooling process is performed. Because of this, the temperature of ejected sheets from which images are erased can be lower. As a result, it is possible to prevent sheets from adhering to each other with toner.

While certain this embodiments have been described, these this embodiments have been presented by way of example only, and are not intended to limit the scope of the inventions. Indeed, the novel this embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus that performs an image forming process to form an image on a sheet, and performs an image decoloring process to decolor an image formed on a sheet, comprising:

a conveying device that conveys the sheet;

a heater that heats the sheet conveyed by the conveying device to perform the image decoloring process;

a cooling device that performs a cooling process to cool the heater; and a processor that controls the cooling device so that the cooling device performs the cooling process between an interval of heating successive sheets by the heater, wherein:

when an instruction is received to start the image decoloring process before the cooling process is complete, the processor controls the cooling device to continue the cooling process before the heater starts the image decoloring process, and causes the heater to perform the image decoloring process after the cooling process is complete.

2. The image forming apparatus according to claim 1, wherein, the cooling device is located above the heater.

3. The image forming apparatus according to claim 1, wherein, the processor causes the cooling device to cool the heater at a predetermined timing when the heating for the image decoloring process is performed.

4. The image forming apparatus according to claim 3, wherein, the predetermined timing is determined based on at least one of: the number of sheets from which images are decolored, an elapsed time after the heating for the image decoloring process is started, and a temperature of the heater.

5. The image forming apparatus according to claim 3, wherein, the cooling process includes a first cooling process performed at a first predetermined timing, the first predetermined timing being timing at which the total number of sheets from which images are decolored reaches a predetermined threshold number, and a second cooling process performed at a second predetermined timing, the second predetermined timing being timing at which the image decoloring process is completed.

6. The image forming apparatus according to claim 5, further comprising:

a control panel that receives an instruction to perform the image decoloring process by the heater, wherein the processor detects, when the control panel receives the instruction to perform the image decoloring process, if the cooling process is complete or not, and determines, if the processor detects that the cooling process is not complete, whether the not completed cooling process is the first cooling process or the second cooling process.

7. The image forming apparatus according to claim 6, wherein, if the processor determines that the not completed cooling process is the first cooling process, the processor causes the cooling device to continue the first cooling process, after temperature of the heater drops below a predetermined target temperature in the first cooling process, causes the cooling device to complete the first cooling process, and after the first cooling process is completed, based on the received instruction to perform the image decoloring process, causes the heater to perform the image decoloring process.

8. The image forming apparatus according to claim 7, wherein, if the processor determines that the not completed cooling process is the second cooling process, the processor causes the cooling device to finish the second cooling process, and after the second cooling process is finished, based on the received instruction to perform the image decoloring process, causes the heater to perform the image decoloring process.

9. A method of controlling an image decoloring apparatus that performs an image decoloring process to decolor an image formed on a sheet, the method comprising the steps of:

controlling a heater to perform the image decoloring process by heating the sheet conveyed by a conveying device;

controlling a cooling device to perform a cooling process to cool the heater;

before the cooling process is complete, receiving an instruction to start a new image decoloring process;

controlling the cooling device to continue the cooling process before the heater starts the new image decoloring process; and when the cooling process is complete, controlling the heater to perform the new image decoloring process.

* * * * *